United States Patent [19]

Van Zanten et al.

[11] Patent Number: 5,041,006

[45] Date of Patent: Aug. 20, 1991

[54] INSULATION DISPLACEMENT CONTACT ELEMENT

[75] Inventors: Albertus Van Zanten, DP'S-Hertogenbosch; Van Woensel, Johannes M. B., EG Rosmalen, both of Netherlands

[73] Assignee: E. I. Du Pont de Nemours and Company, Wilmington, Del.

[21] Appl. No.: 525,739

[22] Filed: May 21, 1990

[30] Foreign Application Priority Data

Jun. 9, 1989 [NL] Netherlands ..... 8901477

[51] Int. Cl.[5] ..... H01R 4/24

[52] U.S. Cl. ..... 439/397; 439/856; 29/874

[58] Field of Search ..... 439/389–407, 439/851, 856, 857; 29/857, 861, 874, 882

[56] References Cited

U.S. PATENT DOCUMENTS

| | | | |
|---|---|---|---|
| 4,040,705 | 8/1977 | Huber | 439/397 |
| 4,232,927 | 11/1980 | Stull | 439/397 |
| 4,265,504 | 5/1981 | Burns | 439/397 |
| 4,346,955 | 8/1982 | Chesnais et al. | 439/407 |
| 4,699,441 | 10/1987 | D'Urso et al. | 439/397 |
| 4,840,578 | 6/1989 | Sato | 439/402 |

FOREIGN PATENT DOCUMENTS

| | | | |
|---|---|---|---|
| 0082697 | 6/1983 | European Pat. Off. . | |
| 0262775 | 6/1988 | European Pat. Off. . | |
| 0321285 | 6/1989 | European Pat. Off. | 439/397 |
| 2653593 | 10/1988 | Fed. Rep. of Germany . | |
| 1558582 | 11/1976 | Netherlands . | |

*Primary Examiner*—David L. Pirlot

[57] ABSTRACT

A contact element having a cutting section for insulation displacement connection of an insulated electrical conductor. The contact element being folded from a flat sheet of electrical conducting material, having a generally rectangular part which bears a lip projecting from one of its sides provided with a cutting slit in the end face and an angular piece having a part connected to said rectangular part and extending essentially parallel to said lip, and having a part which is at right angles thereto and faces away from said lip. The last mentioned part being provided with a further cutting slit in the end face. By appropriate folding of said flat sheet, a contact element being provided having a cutting section for side-piercing of an electrical conductor.

5 Claims, 1 Drawing Sheet

INSULATION DISPLACEMENT CONTACT ELEMENT

BACKGROUND OF THE INVENTION

This invention relates to a connector contact element and in particular to an insulation displacement contact element.

Insulation displacement contact elements folded from flat metal sheets are known in the prior art. German Patent Specification No. 2,653,593, for example, shows a contact element which is formed from a flat sheet for relatively complex shape. The slits for insulation displacement contact of the conductor extend in the same direction as the resilient lips of the clamp-type fastening part so that the accommodated conductor is at right angles to the lengthwise direction of the contact element.

SUMMARY OF THE INVENTION

The object of the present invention is to provide an insulation displacement contact element which is formed from a simple flat sheet and in which the slits are arranged in such a way that the accommodated conductor extends in the lengthwise direction of the element.

This object is achieved through the fact that the contact element according to the invention is folded from a flat sheet which has a generally rectangular part and which has a lip projecting from one of its sides terminating in a cutting slit at its end and an angular piece also projecting from this one side of the rectangular part and extending essentially parallel to the projecting lip. This angular piece includes a portion which is at right angles thereto and faces away from said lip and which terminates in a second cutting slit at its end. The rectangular part of the flat sheet is folded to form a rectangular channel along a first pair of fold lines at a distance from each other and running virtually parallel to each other, so that one of the sides of said channel extends as the projecting lip and the bottom of the channel extends as the angular piece. The angular piece is folded inwards through a second fold line standing at right angles to the first pair of fold lines, in such a way that the part with the slit rests on the projecting lip extending from a side of the channel, and the end part of the extending lip with the slit formed therein is folded inwards essentially through a right angle through a third fold line running parallel to the second fold line.

A pair of parallel lip-shaped parts extend from the other side of the rectangular part. The lip-shaped parts are spaced apart and separated by a rectangular recess. After folding of the flat sheet to form a rectangular channel, the sides of said channel extend by said lip-type parts which at their ends form a clamp-type fastening part of the contact element made up of two resilient contact lips.

The invention is explained in greater detail with reference to the drawing, in which:

DETAILED DESCRIPTION OF THE EMBODIMENT

Figure 1:
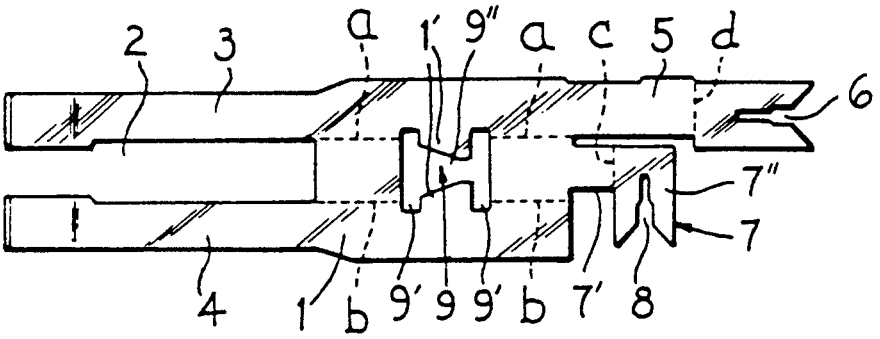
FIG. 1 shows a flat sheet from which the contact element according to the invention is folded.

As shown in FIG. 1, the flat sheet has a generally rectangular part 1, in which a generally rectangular recess 2 is provided at one side so that two lip-type parts 3 and 4 are formed. At the opposite side of the rectangular part 1, a projecting lip 5 is present, with a slit 6 disposed in the end face thereof. This side of the rectangular part 1 also has formed in it an angular piece 7, with a part 7' connected to the rectangular part 1, and a part 7'' standing at right angles thereto, in which a second slit 8 at right angle is disposed.

The rectangular part 1 also contains a recess 9. This recess is in the form of two slits 9' spaced apart and running parallel to each other, and a triangular part 9'' situated between them.

Figure 2:
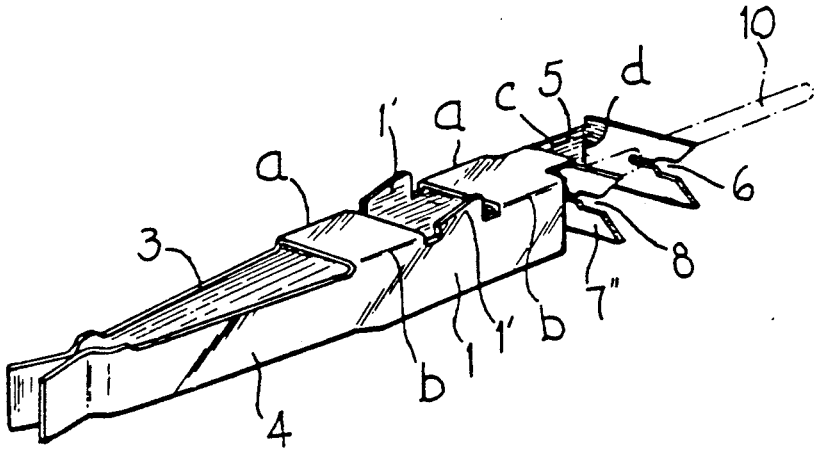
FIG. 2 shows the contact element in perspective.

As shown in FIG. 2, the flat sheet is bent along the fold lines a and b to form a rectangular channel, the parts of the rectangular part 1 situated on either side of the triangular part 9'' of the recess 9 forming raised, generally trapezoidal projections 1'. The latter are used for fastening the contact element in a housing, which is not shown.

The angular piece 7 is also folded inwards along the fold line c, so that he part 7'' with the slit 8 formed therein comes to rest on the projecting lip 5.

Finally, the end part of the projecting lip 5 is folded inwards round the fold line d. As a result, the slits 6 and 8 are disposed parallel to each other.

Reference number 10 shows a conductor which is pressed into the slits 6 and 8. The edges of these slits cut through the insulation of the conductor until they come into contact with the conductive core. FIG. 2 thus shows clearly that the conductor 10 extends in the lengthwise direction of the contact element.

We claim:

1. A method for forming an insulation displacement contact element comprising the steps of:

forming a flat sheet of conductive material having a generally rectangular part with two lip members extending essentially parallel to one another from one side of the rectangular part and with two projections extending from an opening side of the rectangular part, one of said projections terminating in a first cutting slit extending in a direction parallel to said lip members, a second of said projections terminating in a second cutting slit extending in a direction perpendicular to the first cutting slit, folding the flat sheet along a first lengthwise fold line whereby one of the lip members, a portion of the rectangular part and said one projection with said first cutting slit is perpendicular to the rest of the flat sheet, folding the flat sheet along a second lengthwise fold line whereby the second of the lip members and another portion of the rectangular part is parallel to the first folded portion so that a rectangular channel is formed between the first two fold lines, the bottom of said channel containing the remaining unbent portion of said rectangular part and the second projection containing the second cutting slit, and forming said first and second sets of cutting slits through approximately ninety degrees along third and fourth fold lines, respectively, which are both perpendicular to said first and second fold lines.

whereby said first and second cutting slits are spaced parallel to one another and extend in a direction perpendicular to said channel.

2. The method of claim 1 wherein a recess is formed in the center of the rectangular part, said recess formed of two slots spaced apart and parallel to each other and joined by a triangular part so that when the flat sheet is folded along the first and second fold lines, opposite sides of the triangular part of the recess will be raised upward to form parallel trapezoidal projections which may be used for fastening the contact element in a housing.

3. An insulation displacement contact element formed by the method of claim 1.

4. A cutting contact element formed by folding from a flat sheet and comprising two parallel lips projecting opposite each other, and a pair of parallel slits whose edges are adapted to cut through insulation of a conductor which is pressed into said slits until they come into contact with a conducting core of the conductor, said flat sheet having a generally rectangular part which has a first projection extending from one of side thereof terminating in a first of said cutting slits, and a second projection also extending from said one side of the rectangular part and extending essentially parallel to the first projection and terminating in a second of said cutting slits which is perpendicular to said second projection, the rectangular part of the flat sheet being folded to form a rectangular channel along two first fold lines at a distance from each other and running substantially parallel to each other so that one of the sides of said channel includes the first projection and the bottom of the channel includes the second projection, the second projection being folded inwards through a second fold line perpendicular to the first two fold lines in such a way that the second slit rest on the first projection extending along a side of the channel, and the termination of said first projection with said first slit being folded inwards essentially through a right angle at a third fold line running parallel to the second fold line so that the slits are parallel to one another.

5. The contact element of claim 4 wherein each of said pair of lips extend in opposite sides of said channel from an opening side of the rectangular part to form resilient contact lips.

* * * * *